US010597890B2

(12) United States Patent
Hill

(10) Patent No.: US 10,597,890 B2
(45) **Date of Patent: *Mar. 24, 2020**

(54) LATERALLY ADJUSTABLE POST BASE ASSEMBLY

(71) Applicant: Oz-Post International, LLC, Richardson, TX (US)

(72) Inventor: Ian A. Hill, Plano, TX (US)

(73) Assignee: Oz-Post International, LLC, Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/400,346

(22) Filed: May 1, 2019

(65) Prior Publication Data

US 2019/0257109 A1 Aug. 22, 2019

Related U.S. Application Data

(63) Continuation of application No. 15/792,415, filed on Oct. 24, 2017, now Pat. No. 10,316,538.

(51) Int. Cl.
*E04H 12/22* (2006.01)

(52) U.S. Cl.
CPC ..... *E04H 12/2261* (2013.01); *E04H 12/2284* (2013.01); *E04H 12/2292* (2013.01)

(58) Field of Classification Search
CPC ..... E04B 5/12; E04B 2001/2684; E04C 3/30; E04F 11/1812; E04H 12/2261; E04H 12/2284
See application file for complete search history.

(56) References Cited

U.S. PATENT DOCUMENTS

| | | | |
|---|---|---|---|
| D254,476 | S | 3/1980 | Gilb |
| 4,199,908 | A | 4/1980 | Teeters |
| 4,924,648 | A | 5/1990 | Gilb et al. |
| 5,467,569 | A | 11/1995 | Chiodo |
| 5,575,130 | A | 11/1996 | Chiodo |
| 5,794,395 | A | 8/1998 | Reed |
| 6,513,290 | B2 | 2/2003 | Leek |
| 7,243,473 | B2 | 7/2007 | Terrels |
| 7,677,522 | B2 | 3/2010 | Bakos |
| 7,992,362 | B2 | 8/2011 | Petta |
| 8,573,545 | B2 | 11/2013 | Walquist et al. |
| 8,622,364 | B2 | 1/2014 | Bergman |
| 8,782,978 | B1 | 7/2014 | Frenette et al. |
| 8,959,857 | B1 | 2/2015 | Lin |
| 9,010,062 | B2 | 4/2015 | Hill |
| 9,027,897 | B2 | 5/2015 | Hill |
| 2002/0139069 | A1 | 10/2002 | Buffkin et al. |
| 2004/0206028 | A1 | 10/2004 | Terrels et al. |
| 2008/0283702 | A1 | 11/2008 | Ikerd |
| 2012/0085050 | A1 | 4/2012 | Greenwood |
| 2013/0146606 | A1 | 6/2013 | Blay Orenga et al. |

*Primary Examiner* — Bradley Duckworth
(74) *Attorney, Agent, or Firm* — Foley & Lardner LLP

(57) ABSTRACT

A post base includes a base member comprising post support wall and a plurality of peripheral side walls extending from the post support wall. The base member further comprises a first tab and a second tab, each extending inward. A plurality of stirrup plates each include at least one slot sized and shaped to receive one of the plurality of tabs of the base member.

20 Claims, 11 Drawing Sheets

LATERALLY ADJUSTABLE POST BASE ASSEMBLY

CROSS-REFERENCE TO RELATED APPLICATIONS

This application is a continuation of U.S. patent application Ser. No. 15/792,415, filed on Oct. 24, 2017, now pending, the disclosure of which is hereby incorporated by reference.

This application is subject matter related to U.S. Pat. No. 9,027,897, entitled "Standoff Connector for Use, for Example, as a Post Base," filed on Jun. 14, 2013, which claims priority from U.S. Provisional Application for Patent No. 61/660,871 filed Jun. 18, 2012, the disclosures of which are incorporated by reference.

BACKGROUND OF THE INVENTION

Technical Field of the Invention

The present invention relates generally to a standoff connector for use in supporting a wood structural member.

Description of Related Art

It is well known to those skilled in the art that wood structural members, for example, wood post members, must be raised above concrete surfaces that are subject to wetting. It is conventional to use a standoff connector of some type as a base for such installations. A typical standoff connector includes a base plate (with means for supporting attachment of the base plate to an underlying substrate such as a concrete surface) and at least one pair of laterally spaced apart stirrup members mounted to and extending upwardly from the base plate. The base plate is provided with a thickness in accordance with commercial and residential building codes, typically of between one-half to one inch, to ensure that any wood structural member supported by the standoff connector is attached is sufficiently spaced above the underlying substrate.

For installation, the base plate is first secured to the underlying substrate. A bottom surface of the wood structural member is then placed between the pair of laterally spaced apart stirrup members in a position resting on a top surface of the base plate. The stirrup members are arranged against side surfaces of the received wood structural member. Mounting devices, such as screws or bolts, are then driven through the stirrup members, for example through openings provided therein, to pass into (and perhaps through) the wood structural member. The wood structural member is thus secured to the standoff connector, with the standoff connector secured to the underlying substrate. The thickness of the base plate separates the bottom surface of the wood structural member from the underlying substrate.

The standoff connector is typically formed of galvanized steel and has a utilitarian appearance driven by its functional configuration. In most applications, it is preferred that such a standoff connector not be visible. It is thus typical for some form of finish carpentry to be used to conceal the standoff connector from view. For example, the finish carpentry may box or case around the standoff connector with wood trim pieces of a type similar to, or complementary of, the supported wood structural member. There is accordingly an added cost to use of the standoff connector that is associated with the need to hide the connector itself.

SUMMARY

In accordance with an embodiment, a post base assembly includes a base member comprising post support wall and a plurality of peripheral side walls extending from the post support wall. The post support wall defines a first cutout and a second cutout that is disposed opposite the first cutout. The base member further includes a plurality of tabs that each extend inward toward a first wall of a respective cutout. A plurality of stirrup plates each include a center tab and at least one slot sized and shaped to receive one of the plurality of tabs of the base member. A mounting face defines at least one mounting hole that is configured to receive a mounting device to secure the stirrup plate to a face of a structural member.

In one embodiment, each stirrup plate includes a threaded through hole that is configured to receive a bolt or other threaded rod. Rotation of the bolt laterally adjusts the position of the stirrup plate to accommodate a variety of sizes of a structural member.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
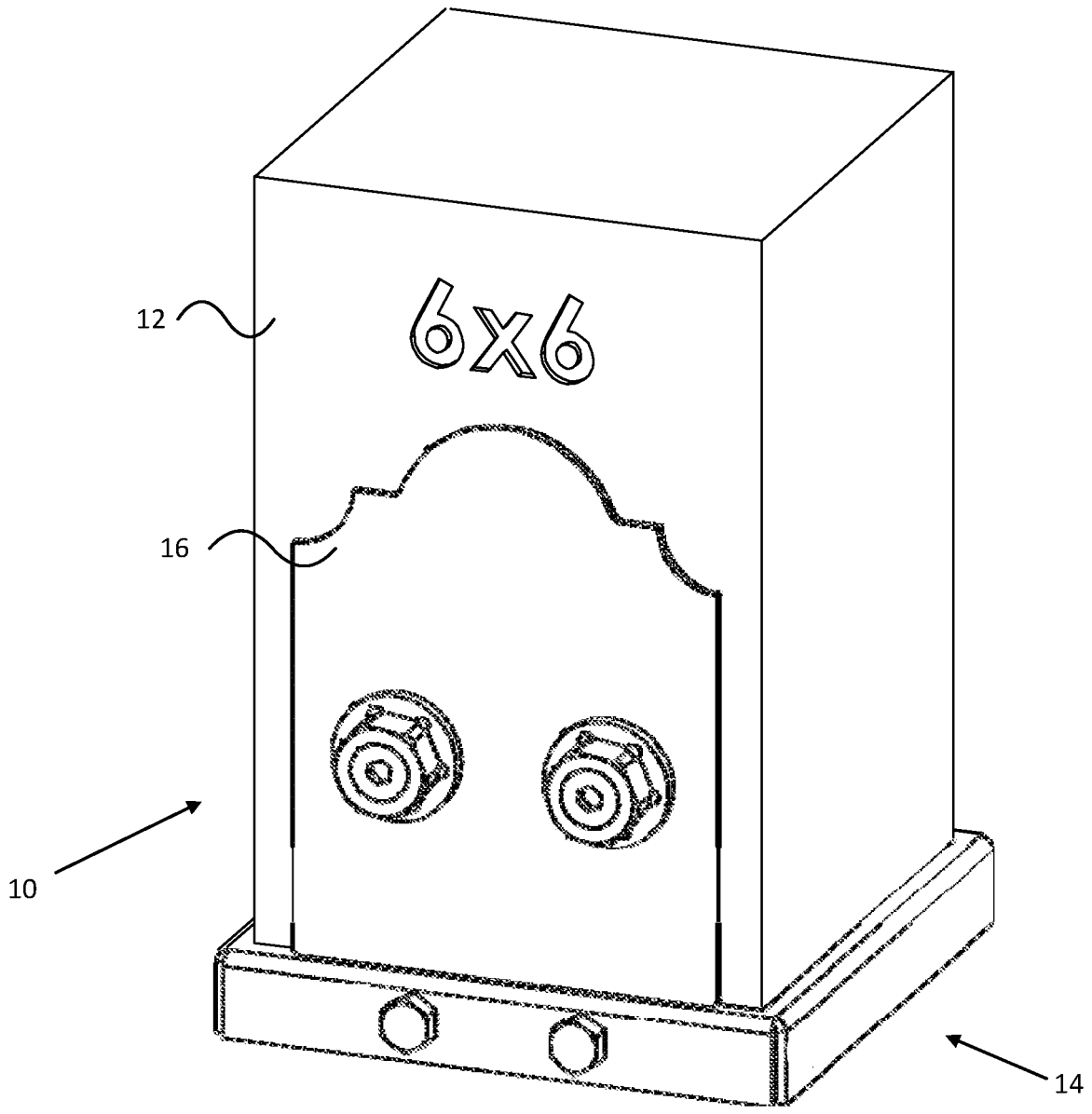
FIG. 1 is an environmental, isometric view of a post base assembly supporting a structural member.

Reference is made to FIG. 1 which shows a perspective view of a post base assembly 10 coupled to a wood structural member 12 (in this case comprising a wood post member). The wood structural member 12 may be a support post for an outdoor structure, such as a pergola or a gazebo. The post base assembly 10 separates the post 12 from a concrete slab or other foundation. The post base assembly also structurally holds the structural member 12, and thus the outdoor structure, in place in the event of high winds or other adverse weather conditions. The post base assembly 10 includes a base member 14 and a plurality of stirrup plates 16 that are laterally adjustable to accommodate differently sized structural members, as explained in further detail below.

Figure 2:
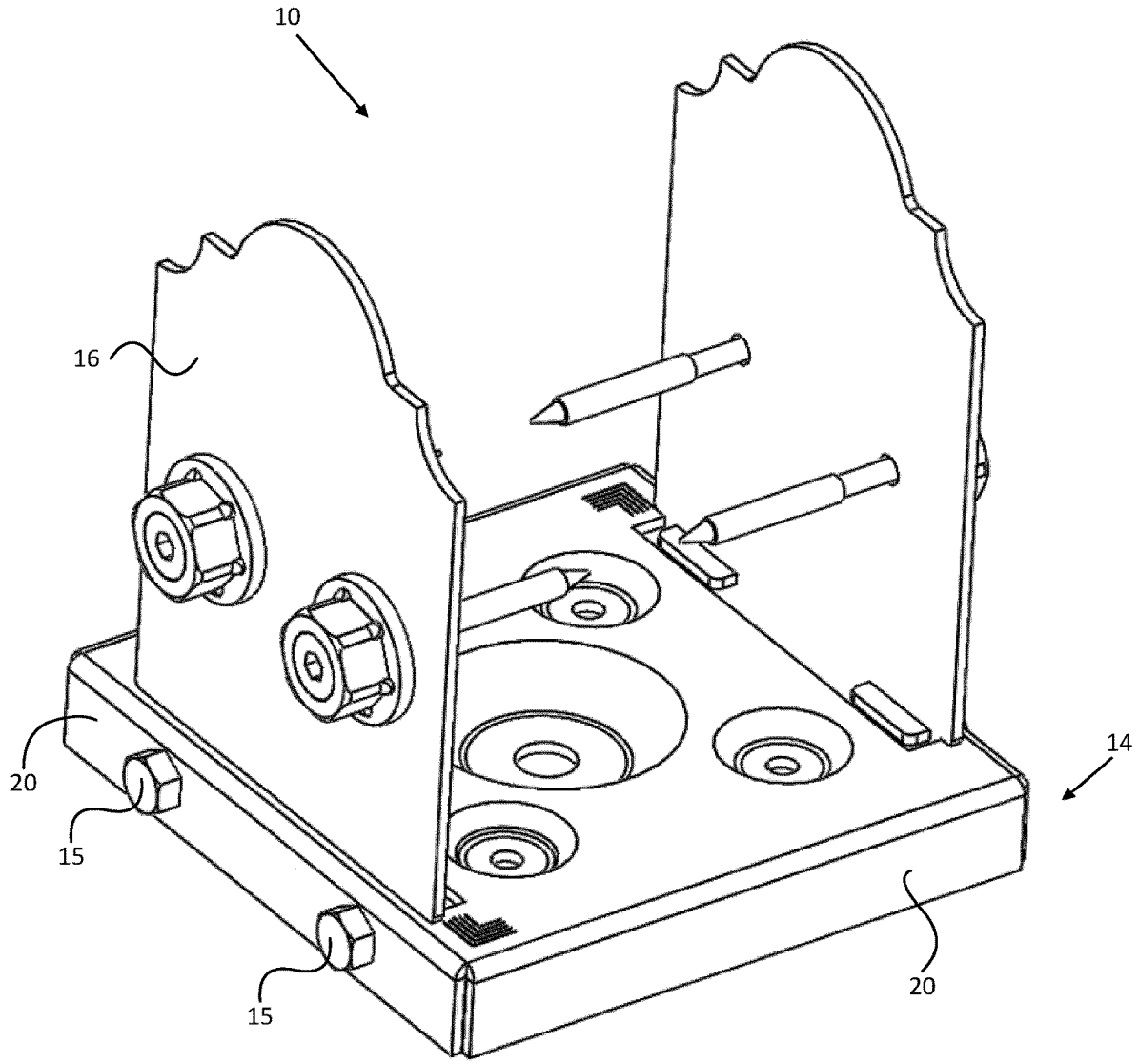
FIG. 2 is an isometric view of the post base assembly of FIG. 1.

Reference is now made to FIG. 2 which shows an isometric view of the post base assembly 10 with the structural member removed. The base member 14 includes a post support wall 18 and four peripheral walls 20. The peripheral walls 20 generally follow the periphery of the base member 14. The peripheral side walls 20 extend from the post support wall. More specifically, a bend 21 is formed at the junction of each peripheral wall 20 and the post support wall 18. According to certain embodiments, the bend results from the formation of the sheet metal into the base member. Portions are cut away from a periphery of a flat sheet of metal, such as steel, and the periphery is folded into the peripheral side walls 20 and the bends 21 are formed.

According to some embodiments, the four peripheral walls 20 appear as a generally continuous perimeter surface. Each peripheral side wall 20 presents a planar surface. Conventional post bases may have an interrupted perimeter surface and exposed tabs. This may present a less attractive appearance, particularly if the post base is intended to support four stirrup plates, but only two are used. In this instance, tabs that are not supporting stirrup plates may extend from two sides of the periphery of the base plate.

The stirrup plates 16 are laterally adjustable, toward and away from a center of the base member 14 using adjustment bolts 15 that extend through one or more through holes formed in at least two of the four peripheral walls. Mounting devices 80 secure the stirrup plate 16 to the face of the structural member 12.

Figure 3:
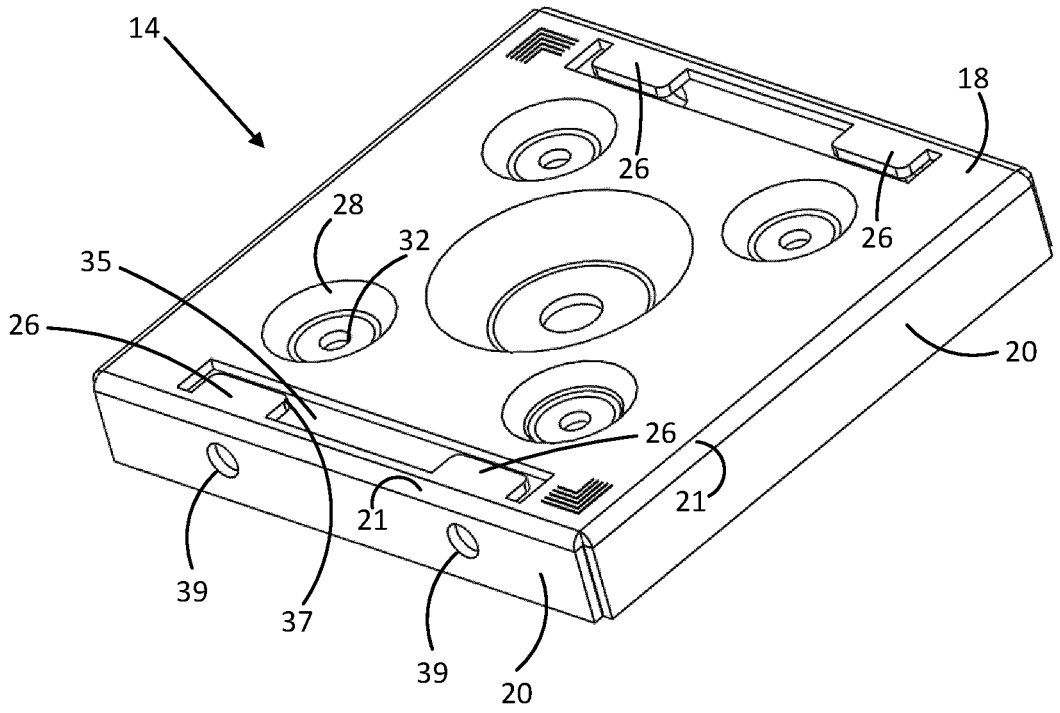
FIG. 3 is an isometric view of a base member of the post base assembly of FIG. 1.

Reference is made to FIG. 3, which is an isometric view of the base member 14. A plurality of dimples is formed in the post support wall 18. Each dimple 28 includes a mounting opening 32 configured to receive a mounting device, such as a screw or bolt (not shown), which would be used to attach the base member 14 to a supporting substrate surface (such as a concrete surface). The dimples 28 are formed with a depth sufficient to fully receive a head portion of the mounting device. With the dimples 28, the head portions of received mounting devices are recessed below a top surface 30 of the post support wall 18. This configuration will allow the bottom surface of the wood structural member 12 to rest flush on the top surface 30 of the post support wall 18. The center dimple 28 is optional and may instead be omitted completely.

A rectangular-shaped, cutout 35, which is closed on its four peripheral sides, is also made in the post support wall 18. At least one tab or projection 26 extends into the cutout 35, and therefore toward a center of the post support wall 18. The cutout 35 is disposed at a periphery of the post support wall 18. There is a gap 37 disposed between and end of the tabs 26 and a wall of the cutout 35. The gap 37 receives a lower portion of the stirrup plate 16 to allow slots 46 of the stirrup plate 16 to receive the tabs 26 of the base member 14. According to one embodiment, a cutout 35 and tabs 26 are formed proximate two opposing peripheral side walls 20 of the base member 14. According to an alternate embodiment, a cutout 35 and tabs 26 are formed proximate all four peripheral side walls 20 of the base member 14. Regardless whether the base member 14 includes two or four cutouts 35 and tabs 26, the cutout 35 and tabs 26 will be disposed underneath the post 12 and hidden from view when the post base assembly 10 is supporting a post 12.

At least one through hole 39 is formed through opposed peripheral walls 20. According to some embodiments, a pair of through holes 39 is formed in opposed peripheral walls 20. According to a further alternate embodiment, one or a pair of through holes 39 is formed through all four peripheral walls 20. As discussed further below, the through holes 39 receive bolts 15 that are configured to be threadedly engaged with threaded holes 45 formed in the stirrup plates 16, which allow a lateral position of the stirrup plates 16 to be adjusted.

The base member 14 is formed of sheet metal, for example ASTM A36 steel. The base member is formed using sheet metal forming processes, such as bending to formed the peripheral walls 20 and stamping to form the cutout 35, tabs 26, dimples 28, mounting openings 32, and through holes 39. Such sheet metal forming operations may be more efficient and less expensive than welding separate parts together to form a base member. According to one embodiment, the sheet metal used to form the base member 14 is a sheet of steel having a thickness in a range of 2-5 millimeters (0.08-0.20 inches), for example 3 millimeters (0.12 inches). According to certain embodiments, the thickness of the steel can be up to 6.35 millimeters (0.25 inches). The base member 14 may be powder coated or otherwise finished to present an attractive aesthetic appearance over raw sheet metal, which may be unsightly and require construction of a concealment structure.

Figure 4:
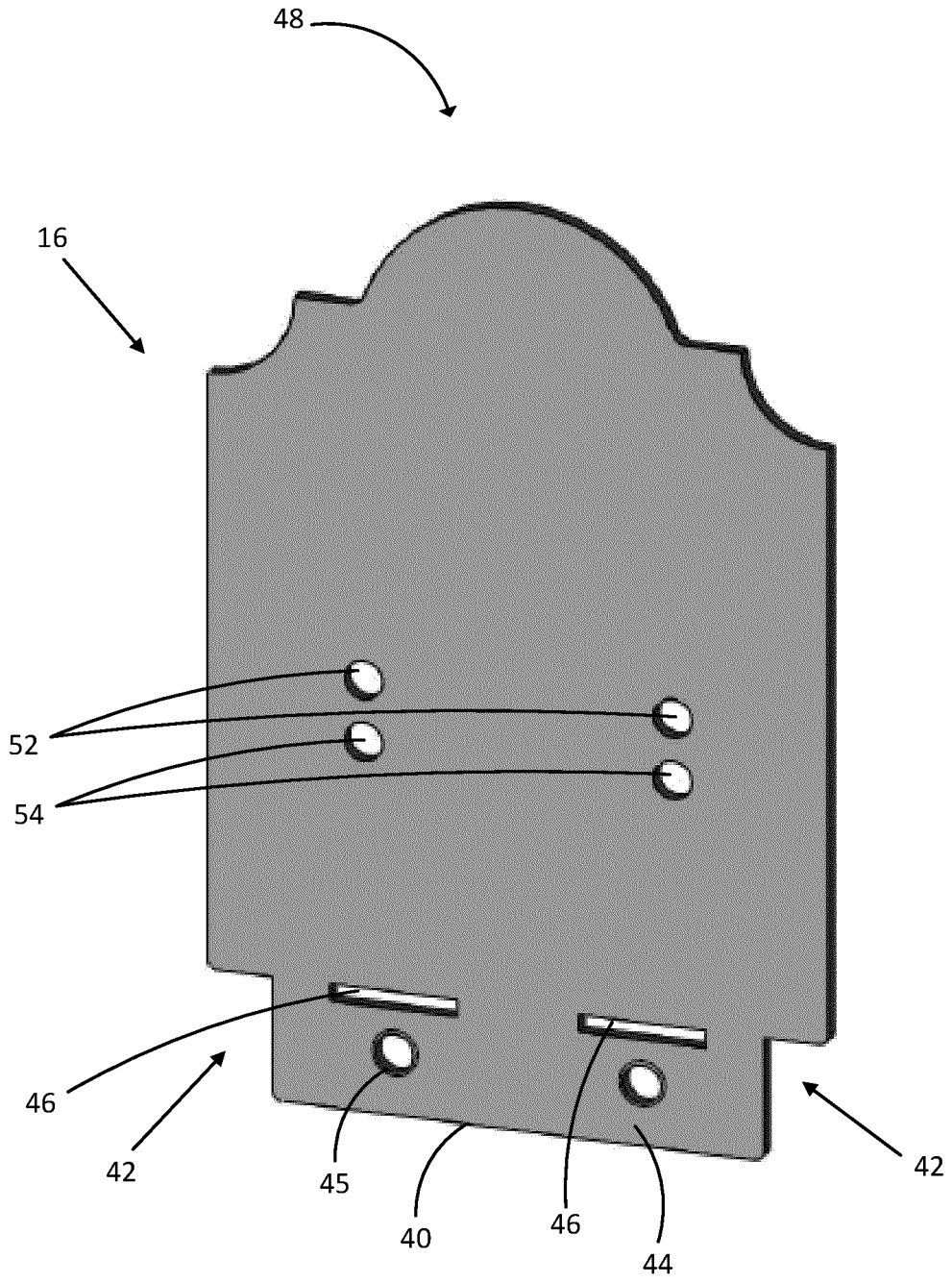
FIG. 4 is an isometric view of a stirrup plate of the post base assembly of FIG. 1.

Reference is now made to FIG. 4 which shows a perspective view of the stirrup plate member 16 for the post base assembly 10. According to an embodiment, the stirrup plate 16 is formed from a piece of sheet metal having a thickness in a range of 2-5 millimeters (0.08-0.20 inches), for example 3 millimeters (0.12 inches). According to certain embodiments, the thickness of the steel can be up to 6.35 millimeters (0.25 inches). The stirrup plate 16 includes a bottom portion with a bottom edge 40. The bottom edge 40 includes end notches 42 defining a center tab 44. The end notches 42 are optional. The center tab 44 is sized, including the thickness of the center tab 44, to be received in the gap 37 within the cutout 35.

At least one slot (aperture) 46 is formed in each center tab 44. The slots 46 are sized and shaped to receive corresponding tabs 26 (FIG. 3). Disposed below each slot 46 is a threaded through hole 45. The threaded through hole 45 receives the adjustment bolts 15. The adjustment bolts 15 allow the position of the stirrup plate 16 to be adjusted to accommodate slightly smaller and slightly larger sized structural members 12.

The bolts 15 received in the threaded holes 45 also further reinforce the connection between the stirrup plate 16 and the base member 14, which may be an improvement over stirrup plates that are coupled to a base member using only tabs received in slots. Such tab/slot only coupling may be susceptible to separation of the stirrup plate from the base member in the event of high winds, such as hurricane force winds. A connection between the stirrup plates 16 and the base member 14 that is reinforced by the bolts 15 and threaded holes 45 may provide stronger structural support for the structural member 12 in the event only two stirrup plates, instead of four, are used with the post base assembly 10.

An upper portion of each stirrup plate member 16 may include a variety of ornamental features 48. Such variety in ornamental design, while retaining a common design and placement of the slots 46 and threaded holes 45, allows for the stirrup plates 16 to be interchanged. Such an interchange may occur in connection with a renovation where the architectural and ornamental style of the construction changes. New stirrup plate members 16, matching the new architectural and ornamental style, can be easily installed without requiring that the wood support member or the base member 14 to be changed.

A central portion of each stirrup plate member 16 includes a plurality of mounting openings. The mounting openings are configured to receive a mounting device 80 (such as a screw or bolt) for attaching the stirrup plate member 16 to a side surface of the wood structural member 12 (FIG. 1). The mounting openings comprise an upper pair of openings 52 and a lower pair of openings 54.

Two pairs of openings 52, 54 are provided to allow a single stirrup plate member 16 to be used at any side position of the post base assembly 10. One plate member 16 may be attached to side surface of the wood structural member 12 using mounting devices 80 inserted through the upper pair of openings 52. A stirrup plate member 16 may be attached to side surface of the wood structural member 12 and positioned adjacent the first stirrup plate 16 using mounting devices 80 inserted through the lower pair of openings 54. This ensures that the mounting devices 80 on adjacent sides of the wood structural member 12 do not interfere with each other when installed. However, it will be noted that only one pair of openings will typically be used on any given stirrup plate member 16. To hide the unused pair of openings, the mounting devices 80 may be sized cover both pairs of openings when installed, or may use other techniques, such as a washer or other structure, sized sufficient to cover both pairs of openings.

Referring back to FIG. 2, which shows an assembled post base assembly 10 including a pair of opposed stirrup plates 16. In assembling the post base assembly 10, the user selects the desired stirrup plate member 16 (based for example on ornamental features and/or size of the wood structural member 12) and installs a stirrup plate member 16 proximate opposed peripheral walls 20 of the base member 14, and alternatively installs a stirrup plate member 16 proximate each of the four peripheral side walls 20. The center tab 44 of the stirrup member 16 is received in the gap 37 within the cutout 35. The stirrup member 16 is positioned such that the slots 46 receive the corresponding tabs 26 of the base member 14. The bolts 15 are received through the through holes 39 in the peripheral wall 20 and threaded into the threaded holes 45 in the stirrup plate 16. The bolts 15 are used to adjust the lateral position of each stirrup plate 16 such that it is flush with the surface of the structural member 12.

Mounting devices 80 are then inserted through one or more of the mounting openings 52, 54 of each stirrup plate member 16 and driven into the side of the wood structural member 12. The interlocking of the stirrup plate members 16 and the base member 14 through the tab 26 and slot 46 and the bolt 15 engaged with the threaded hole 45 arrangement prevents vertical displacement of the stirrup plate members 16 relative to the base member 14, and thus retains the wood structural member 12 to the post support wall 18 of the base member 14.

The base member 14 may be sized relative to the wood structural member 12 being secured. It is known in the art that the stated dimensional size of a wood structural member is not the actual dimensional size. For example, a 6×6 wood post will not typically measure six actual inches on each side. This is especially the case when the wood structural member is something other than "rough cut" (where rough cut members more conventionally are dimensionally accurate or close to dimensionally accurate). The differences in size may, for example, be geographic such that a 6×6 wood post in one geographic region is one size and a 6×6 wood post in another geographic region is another size. Alternatively, the differences in size may vary from lumber mill to lumber mill, or vary depending on the treatment made to the wood. It is not uncommon for a "6×6" wood post to have sides varying from 5.5 inches to 6.0 inches. It is also not uncommon for a square wood structural member to have a non-square cross-section. The post base assembly 10 compensates for the foregoing dimensional variability issues.

The base member 14 is accordingly sized to support the highest expected dimensional size for the wood structural member. Thus, for use in connection with a 6×6 wood structural member, the base member 14 is sized with a supporting footprint slightly larger than 6×6. The cutout 35 and tabs 26 of the base member 14 are sized to support the smallest expected dimensional size for the wood structural member. Thus, for use in connection with a 6×6 wood structural member, cutout 35 and tabs 26 match the 5.5×5.5 inch actual size of the 6×6 wood structural member. With this configuration, the tabs 26 extend into the cutout 35 a length of approximately 0.375 inches, but may extend as far as 0.5 inches. The gap 37 between the wall of the cutout 35 and the end of the tab 26 is approximately 0.14 inches to provide clearance for the center tab 44 of the stirrup plate 16. Thus, the cutout 35 has a width of approximately 0.5 inches. These cutout 35 and tab 26 dimensions permit a range of adjustment in the positioning of the selectably installed stirrup plate members 16 so that the stirrup plate members 16 can be positioned flush against the side surface of the wood structural member, no matter its actual dimensional size. The post base assembly 10 may also be sized to accommodate various actual dimensions of an 8×8 inch post.

Figure 5:
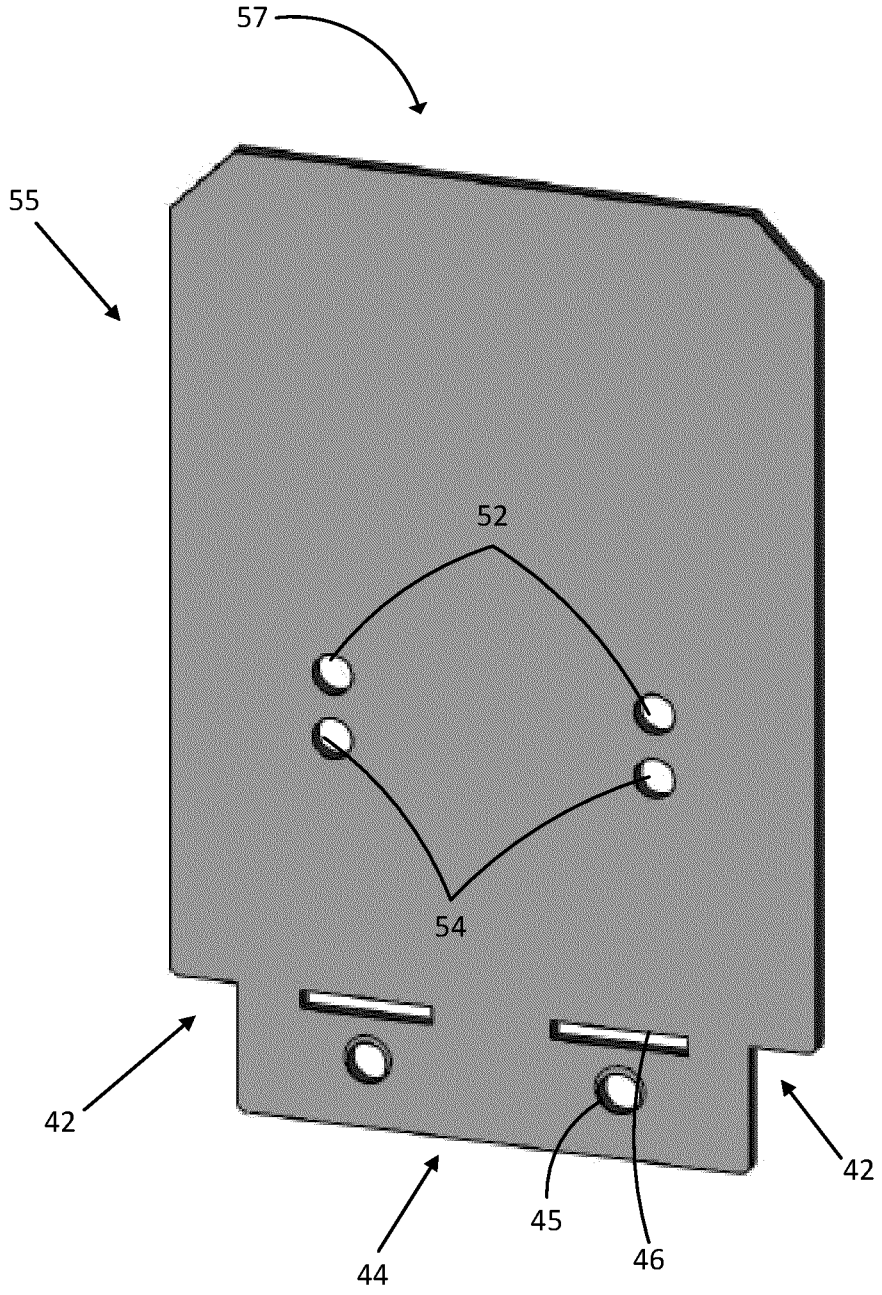
FIG. 5 is an isometric view of an alternate embodiment of a stirrup plate used with a post base assembly according to the teachings of the present disclosure.

Reference is now made to FIG. 5, which is an isometric view of an alternate embodiment of a stirrup plate 55. The stirrup plate 55 is similar to and includes many of the same features shown and described with respect to the stirrup plate 16 shown in FIG. 4. The stirrup plate 55 includes a differently shaped ornamental end 57 than the ornamental end 48 shown in FIG. 4. As described above, a variety of ornamental designs for an exposed ornamental end of a stirrup plate is contemplated by the present disclosure. The stirrup plate 55 includes the slots 46, and the threaded holes 45 formed in a center tab portion 44 that is configured to be received by the cutout 35 in the base member 14. Alternatively, the threaded holes 45 may be omitted. The stirrup plate 55 also includes the openings 52, 54 that receive the mounting devices 80.

Figure 6:
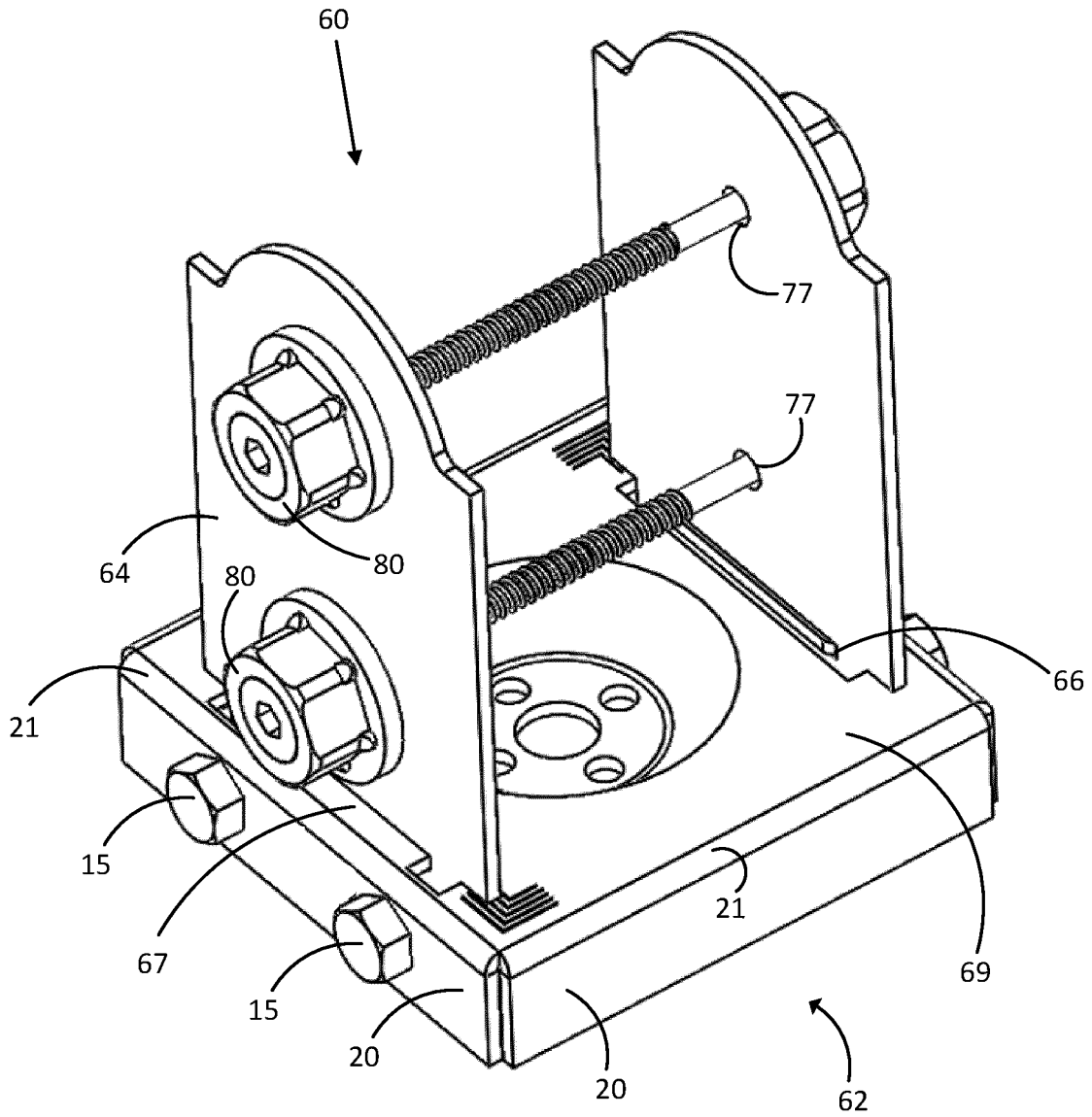
FIG. 6 is an isometric view of an alternate embodiment of a post base assembly.
Figure 7:
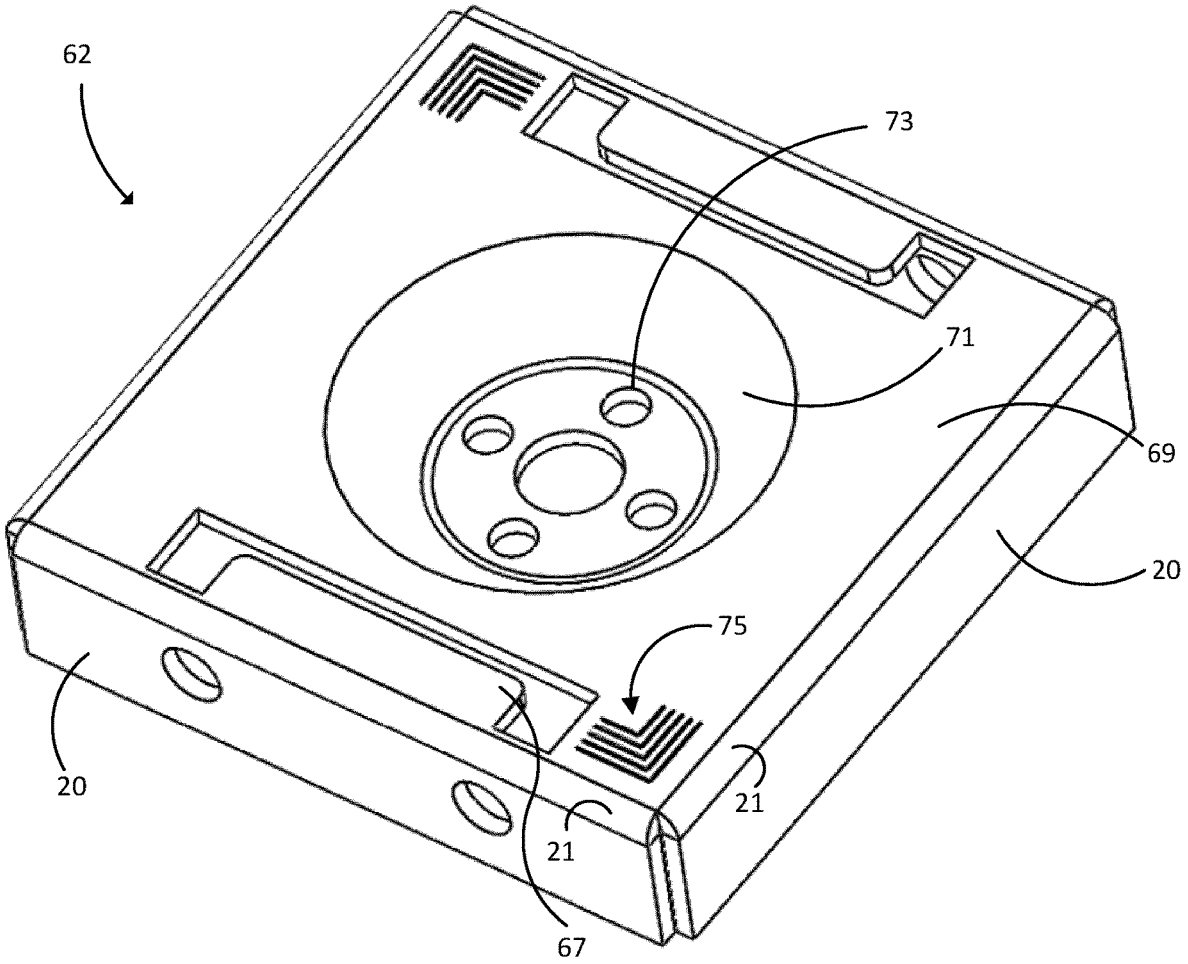
FIG. 7 is an isometric view of a base member of the post base assembly of FIG. 6.

FIG. 6 shows an isometric view of an alternate embodiment of a post base assembly 60 including a base member 62 and stirrup plates 64. The post base assembly 60 is similar to and includes many of the same features as the post base assembly 10 described above with the exception of the size of the components and an elongated tab, as opposed to multiple shorter tabs disposed proximate peripheral side walls of the base member 62. The base member 62 is sized to support a post having a nominal stated size of four inches by four inches. Similar to the base member 14, the base member 62 (shown with the stirrup plates removed in FIG. 7) is sized to accommodate structural members with at least a four inch by four inch cross section. The post base assembly 60 is laterally adjustable using bolts 15 received in threaded holes formed in the stirrup plate to accommodate a variety of sizes of structural members.

The stirrup plates 64 (either two or four) disposed proximate peripheral walls 20 have a width that is less than the stirrup plates 16. The stirrup plates 64 include a single slot 66 that extends substantially the width of the center tab of the stirrup plate 64. The single slot 66 receives a corresponding single tab 67 formed in the post support wall 69 of the base member 62. At least one threaded hole is formed below the single slot 66 to receive the bolt 15 and allow laterally adjustability of the position of the stirrup plates 64.

The post support wall 69 may have a more centralized orientation of a dimple 71 and mounting openings 73, in part, due to the reduced surface area of the post support wall 69. Post position markings 75 may be formed or otherwise created to be visible on the top surface of the post support wall 69. The post position markings 75 may correspond to an optimum post position for differently sized posts.

The post base assembly 60, more specifically the stirrup plates 64, includes holes 71 to support a vertical alignment of the mounting devices 80, due in part to the reduced surface area of the stirrup plate 64. The base member 62 is formed of sheet metal forming techniques including bending, punching, stamping, and the like. The peripheral side walls 20 of the base member 62 present a continuous appearance, which may be an improvement over conventional post base assemblies whose peripheral surfaces may be interrupted and which may include exposed tabs or portions of tabs.

Assembly of the post base assembly 60 and attachment to a structural member is performed consistent with the description above with respect to FIGS. 1-4.

Figure 8:
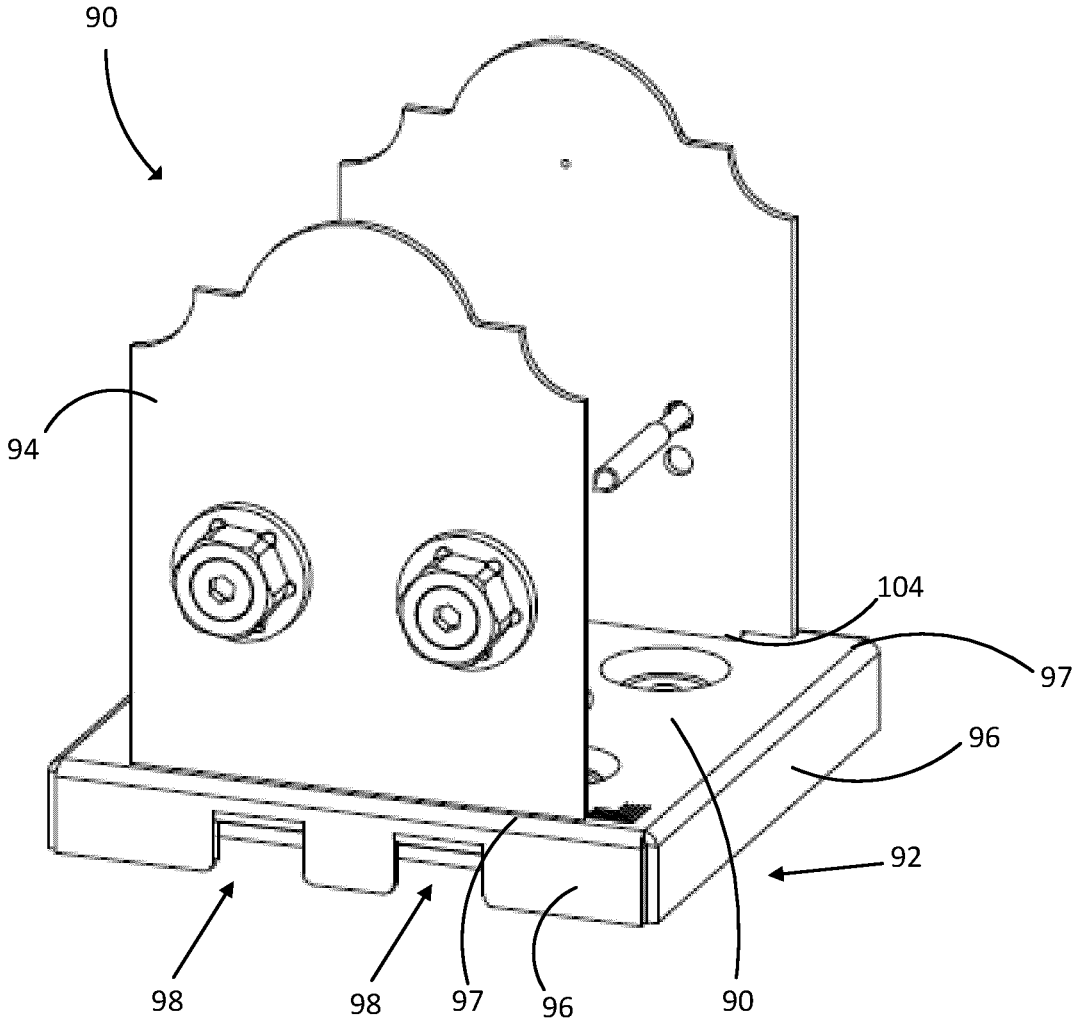
FIG. 8 is an isometric view of a further alternate embodiment of a post base assembly.

FIG. 8 is a further alternate embodiment of a post base assembly 90 that includes a base member 92 and stirrup plates 94. The post base assembly 90 is similar to the post base assembly 10 with the exception of the configuration of the tabs in the base member 92 and the lack of the adjustment bolts. The base member 92 has peripheral side walls 96 that provide a clean, uninterrupted planar appearance on at least two sides of the base member 92. A bend 97 is formed at the junction of each peripheral wall 96 and a post support wall 99. The peripheral walls 96 proximate a stirrup plate 94 include a pair of notches 98. According to one embodiment, the material of the peripheral side wall that would otherwise occupy the notches 98 is perpendicularly bent upward to form a pair of tabs 100. The tabs 100 are received in corresponding slots 102 formed in the lower portion of the stirrup plate 94, as shown in FIG. 9.

Figure 9:
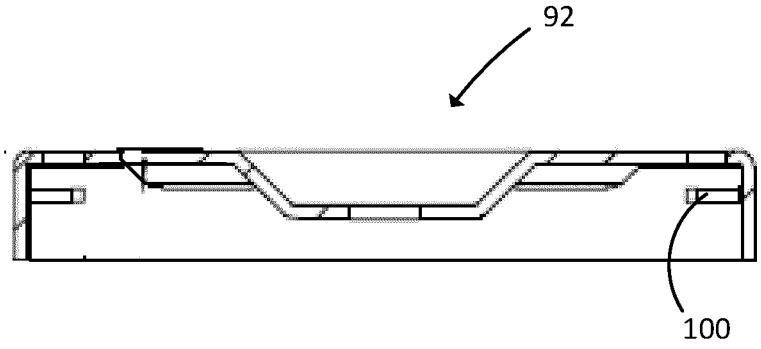
FIG. 9 is a cross section of the base member of the post base assembly of FIG. 8.

FIG. 9 shows a cross section of the base member 92, which shows the position of the tabs 100. Alternatively, the base member 92 may include one tab, for example an elongated tab similar to that shown in FIG. 7, received in a corresponding single slot of a stirrup plate.

The base member 92 is formed using the sheet metal forming techniques described above with respect to the other embodiments of base members. Thus, dimples 28 and mounting holes 32 and a rectangular shaped cutout 104 to receive the center tab 106 of the stirrup plate 94 are formed by deforming and/or removing portions of a sheet of metal, such as steel. The peripheral side walls 96 are bent into the configuration show from a flat piece of sheet metal.

Because of the vertically recessed location of the tabs 100, there is no gap between the sidewalls of the cutout 104 and the end of the tabs 100.

Figure 10:
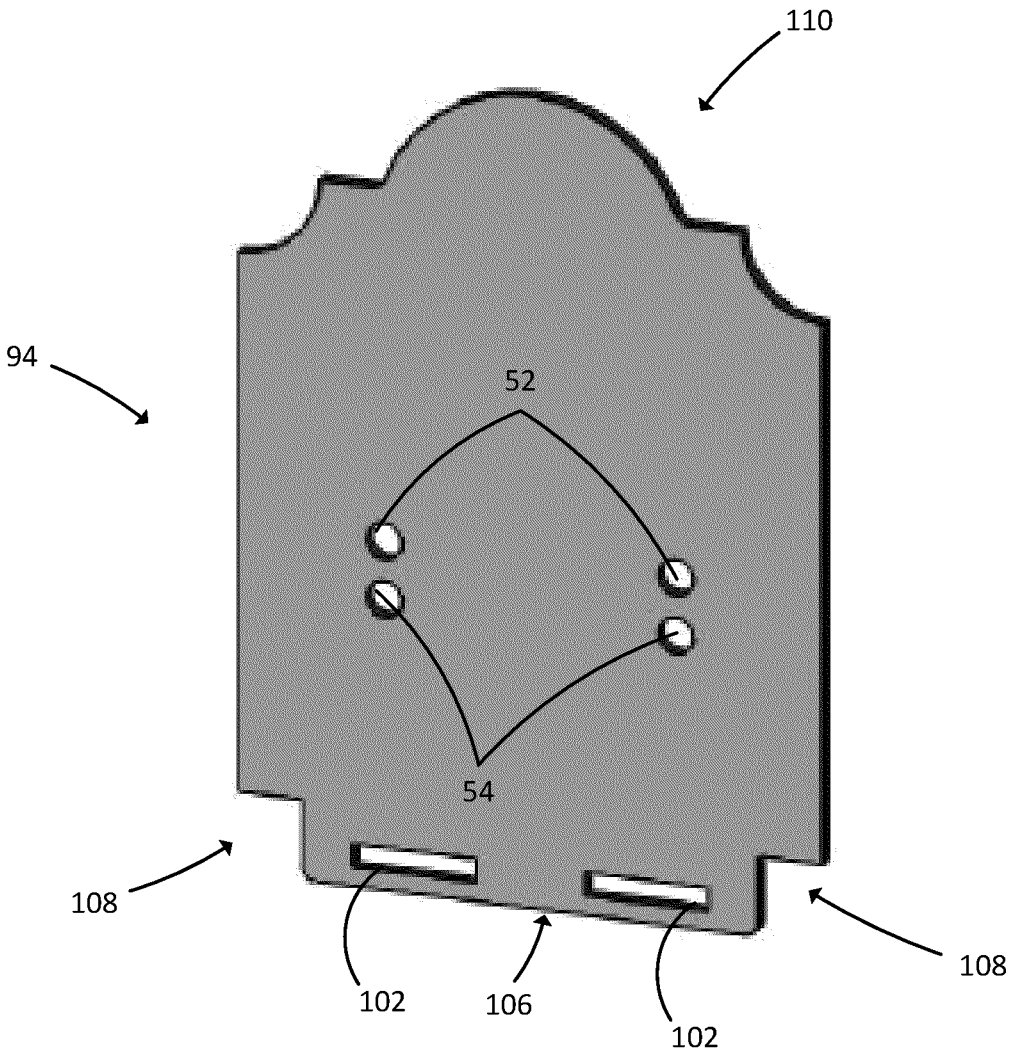
FIG. 10 is an isometric view of a stirrup plate used with the post base assembly of FIG. 8.

FIG. 10 illustrates an isometric view of the stirrup plate 94 shown in FIG. 8. The stirrup plate 94 includes a pair of notches 108 that define the center tab 106 that is received in the cutout 104 of the base member 92. A pair of slots 102 (or a single slot) is formed in the center tab 106. An ornamental end 110 is disposed opposite the center tab 106. At least one pair of through holes, and preferably two pairs of through holes 52, 54 are formed to receive mounting devices 80 that attach the stirrup plate 94 to a face of the structural member and conceal the non-used through holes. Other designs of ornamental ends 110 are contemplated by this disclosure.

Figure 11:
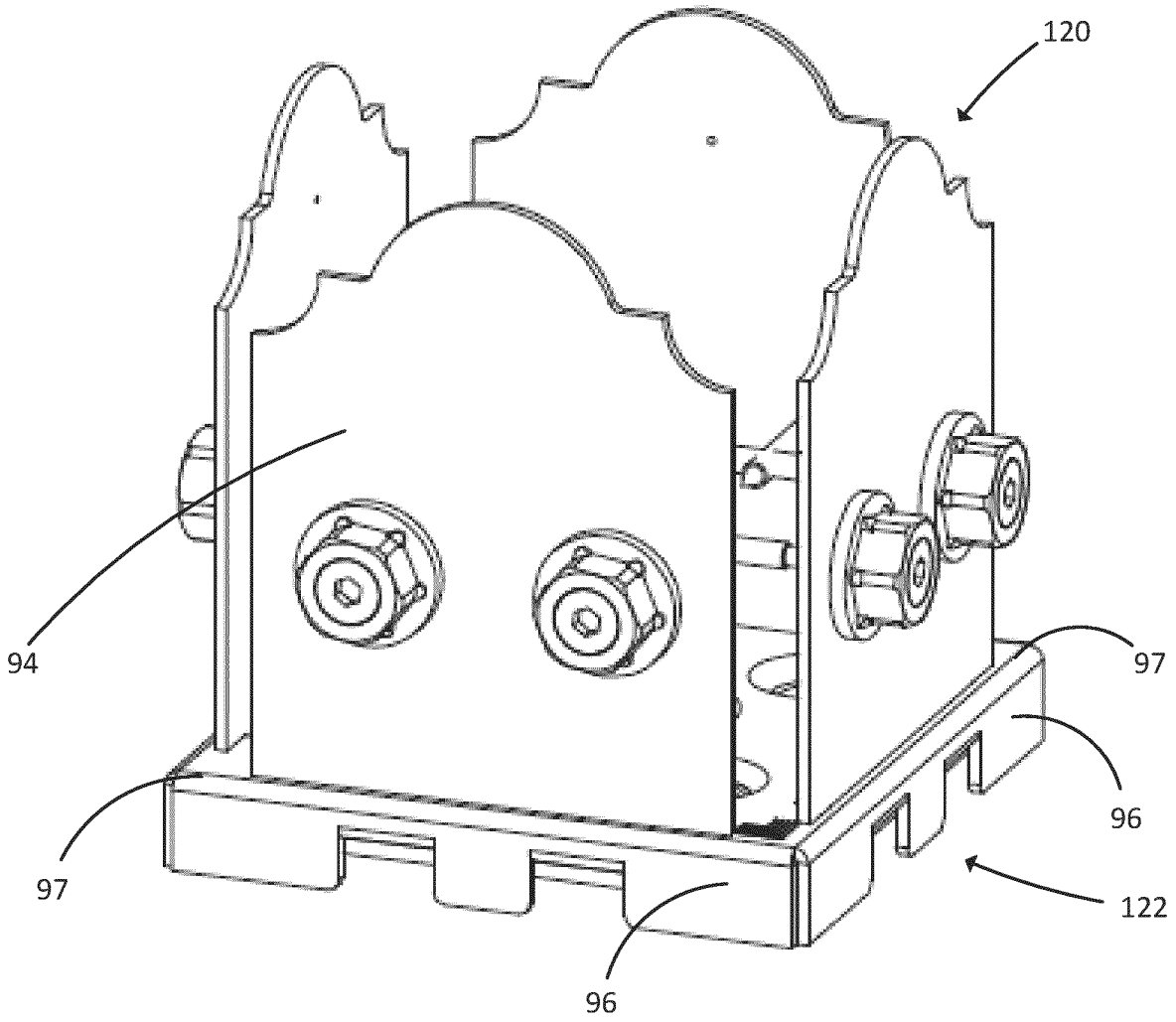
FIG. 11 is an isometric view of a further alternate embodiment of a post base assembly according to the teachings of the present disclosure.

FIG. 11 is an isometric view of a post base assembly 120. The post base assembly 120 is similar to the post base assembly 90 described above with respect to FIGS. 8-10 but the post base assembly 120 includes a base member 122 that is formed to support four stirrup plates 124. Thus, a cutout 104 and tabs 100 are formed proximate each of the four peripheral walls 96.

Mounting devices 80 are then inserted through one or more of the mounting openings 50 of each stirrup plate member 124 and driven into the side of the wood structural member 12. The interlocking of the stirrup plate members 124 and the base member 122 through the tab 100 and slot 102 arrangement prevents vertical displacement of the stirrup plate members 124 relative to the base member 122, and thus retains the wood structural member 12 to the top surface of the post support wall.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A post base, comprising:

a base member comprising a post support wall, a first side wall, and a second side wall, the base member further comprising a first tab disposed proximate and extending inward with respect to the first side wall and a second tab disposed proximate and extending inward with respect to the second side wall;

a first stirrup plate defining a first slot configured to receive the first tab wherein the first stirrup plate is laterally movable on the first tab to position the first stirrup plate in contact with a structural member; and a second stirrup plate defining a second slot configured to receive the second tab wherein the second stirrup plate is laterally movable on the second tab to position the second stirrup plate in contact with the structural member.

2. The post base of claim 1 wherein:

the first stirrup plate defines a first threaded through hole configured to receive a first bolt, the first bolt operable to secure the first stirrup plate laterally on the first tab; and the second stirrup plate defines a second threaded through hole configured to receive a second bolt, the second bolt operable to secure the second stirrup plate laterally on the second tab.

3. The post base of claim 1 wherein the post support wall further comprises a first cutout configured to receive a portion of the first stirrup plate, and a second cutout configured to receive a portion of the second stirrup plate.

4. The post base of claim 3 wherein:

a first gap is disposed between the first tab and a first wall of the first cutout, the first gap sized and shaped to receive the portion of the first stirrup plate; and a second gap is disposed between the second tab and a second wall of the second cutout, the second gap sized and shaped to receive the portion of the second stirrup plate.

5. The post base of claim 1 wherein the first side wall defines at least one first notch bent into the first tab and the second side wall defines at least one second notch bent into the second tab.

6. The post base of claim 1 wherein a first bend is disposed at a junction of the first side wall and the post support wall and a second bend is formed at a junction of the post support wall and the second side wall.

7. The post base of claim 1 wherein each of the first and second side walls is planar.

8. A post base, comprising:

a base member comprising a post support wall and a plurality of peripheral side walls extending from the post support wall, the base member further comprising a plurality of inwardly extending tabs; and a plurality of stirrup plates each comprising a plate tab and at least one slot sized and shaped to receive one of the plurality of inwardly extending tabs and further comprising a mounting face configured to contact a face of a structural member.

9. The post base of claim 8 wherein the post support wall defines a first cutout and a second cutout disposed opposite the first cutout.

10. The post base of claim 8 wherein each stirrup plate defines at least one mounting hole configured to receive a mounting device to secure the stirrup plate to the structural member.

11. The post base of claim 8 wherein each stirrup plate comprises a notch disposed on each side of the plate tab.

12. The post base of claim 8 wherein each stirrup plate includes an ornamental end disposed opposite the plate tab.

13. The post base of claim 8 wherein each stirrup plate defines a threaded through hole configured to receive a bolt, the bolt operable to laterally displace the stirrup plate along the one of the plurality of inwardly extending tabs.

14. The post base of claim 8 wherein the plurality of stirrup plates comprises four stirrup plates.

15. A post base, comprising:

a base member comprising a post support wall, a first side wall, and a second side wall, the base member further comprising a first tab disposed proximate and extending inward with respect to the first side wall and a second tab disposed proximate and extending inward with respect to the second side wall;

a first stirrup plate defining a first slot configured to receive the first tab wherein the first stirrup plate is laterally movable on the first tab to position the first stirrup plate in contact with a structural member; and a second stirrup plate defining a second slot configured to receive the second tab wherein the second stirrup plate is laterally movable on the second tab to position the second stirrup plate in contact with the structural member, wherein each of the first stirrup plate and the second stirrup plates includes an ornamental end.

16. The post base of claim 15 wherein each of the first and second stirrup plates defines a threaded through hole configured to receive a bolt, the bolt operable to secure the stirrup plate laterally on the one of the first or second tabs.

17. The post base of claim 15 wherein each of the first and second stirrup plates comprises a pair of mounting holes configured to receive a mounting device.

18. The post base of claim 15 wherein the post support wall includes at least one through hole configured to receive a foundation mounting device to secure the base member to a foundation.

19. The post base of claim 15 wherein each of the first and second stirrup plates further comprises a plate tab disposed opposite the ornamental end.

20. The post base of claim 15 wherein the first side wall defines at least one first notch bent into the first tab and the second side wall defines at least one second notch bent into the second tab.

* * * * *